US011470435B2

(12) United States Patent
Seo et al.

(10) Patent No.: US 11,470,435 B2
(45) Date of Patent: Oct. 11, 2022

(54) METHOD AND DEVICE FOR PROCESSING AUDIO SIGNALS USING 2-CHANNEL STEREO SPEAKER

(71) Applicant: GAUDIO LAB, INC., Seoul (KR)

(72) Inventors: Jeonghun Seo, Seoul (KR); Taegyu Lee, Seoul (KR); Hyunoh Oh, Gyeonggi-do (KR); Jaesung Choi, Seoul (KR)

(73) Assignee: GAUDIO LAB, INC., Seoul (KR)

( * ) Notice: Subject to any disclaimer, the term of this patent is extended or adjusted under 35 U.S.C. 154(b) by 0 days.

(21) Appl. No.: 17/066,454

(22) Filed: Oct. 8, 2020

(65) Prior Publication Data

US 2021/0112356 A1 Apr. 15, 2021

(30) Foreign Application Priority Data

Oct. 10, 2019 (KR) ..... 10-2019-0125518

(51) Int. Cl.
*H04S 1/00* (2006.01)
*H04S 7/00* (2006.01)

(52) U.S. Cl.
CPC ..... *H04S 1/002* (2013.01); *H04S 1/007* (2013.01); *H04S 2420/01* (2013.01)

(58) Field of Classification Search
None
See application file for complete search history.

(56) References Cited

U.S. PATENT DOCUMENTS 5,173,944 A * 12/1992 Begault ..... G09B 9/22 381/17
2009/0086982 A1 4/2009 Kulkarni et al.
2012/0201389 A1* 8/2012 Emerit ..... H04S 1/002 381/23
2013/0163783 A1 6/2013 Burlingame
(Continued)

FOREIGN PATENT DOCUMENTS

CN 1937854 3/2007
CN 103765507 4/2014
(Continued)

OTHER PUBLICATIONS

Office Action dated Oct. 22, 2021 for Chinese Patent Application No. 202011052559.0 and its English translation provided by Applicant's foreign counsel.
(Continued)

*Primary Examiner* — Qin Zhu
(74) *Attorney, Agent, or Firm* — Ladas & Parry, LLP

(57) ABSTRACT

Disclosed is an audio signal processing device. The audio signal processing device includes a receiving end configured to receive a 2-channel stereo signal and a processor configured to process the 2-channel stereo signal. The processor is configured to filter the 2-channel stereo signal using a spatial distortion removal filter and output the filtered 2-channel stereo signal to a speaker including two or more channels. The spatial distortion removal filter is a filter for offsetting distortion that occurs when the output signal is transmitted from the speaker to a listener, and includes an ipsilateral filter applied to an ipsilateral signal of the 2-channel audio signal and a contralateral filter applied to a contralateral signal of the 2-channel audio signal.

16 Claims, 4 Drawing Sheets

(56) References Cited

U.S. PATENT DOCUMENTS

| | | | | |
|---|---|---|---|---|
| 2017/0325043 | A1* | 11/2017 | Jot | H04S 7/302 |
| 2019/0200159 | A1* | 6/2019 | Park | G10L 21/02 |

FOREIGN PATENT DOCUMENTS

| | | |
|---|---|---|
| CN | 104396279 | 3/2015 |
| CN | 110024421 | 7/2019 |
| KR | 10-0608025 | 8/2006 |

OTHER PUBLICATIONS

Office Action dated May 10, 2022 for Chinese Patent Application No. 202011052559.0 and its English translation provided by Applicant's foreign counsel.

Notice of Allowance dated Jul. 26, 2022 for Chinese Patent Application No. 202011052559.0 and its English translation provided by Applicant's foreign counsel.

* cited by examiner

METHOD AND DEVICE FOR PROCESSING AUDIO SIGNALS USING 2-CHANNEL STEREO SPEAKER

CROSS-REFERENCE TO RELATED APPLICATIONS

This application claims priority to and the benefit of Korean Patent Application No. 10-2019-0125518 filed in the Korean Intellectual Property Office on Oct. 10, 2019, the entire contents of which are incorporated herein by reference.

TECHNICAL FIELD

The present disclosure relates to a method and a device for processing audio signals. Specifically, the present disclosure relates to a method and a device for processing audio signals using a 2-channel stereo speaker.

BACKGROUND ART 3D audio collectively refers to a series of signal processing, transmission, encoding, and reproduction techniques in order to provide realistic sound in 3-dimensional space by providing another axis, corresponding to the height direction, to the sound scene in the horizontal plane (2D) provided by existing surround audio. In particular, in order to provide 3D audio, rendering technology is required in order to form a sound image at a virtual position where no speaker is present, even if a larger number of speakers or a smaller number of speakers is used than in the prior art.

3D audio is expected to become an audio solution corresponding to ultra-high-definition TV (UHDTV), and is expected to be applied to a variety of fields such as those of sound in theaters, personal 3DTV, tablet PCs, wireless communication terminals, cloud-based games, and the like, as well as sound in a vehicle, which is evolving into a high-quality infotainment space.

Meanwhile, there may be a channel-based signal and an object-based signal as forms of sound sources provided to 3D audio. In addition, there may be a sound source in a form in which a channel-based signal and an object-based signal are mixed, and a new way of experiencing content is able to be provided to the user according thereto.

Binaural rendering is modeling of the 3D audio described above into a signal that is transmitted to both ears of a person. The user is able to feel a stereoscopic effect through binaurally rendered 2-channel audio output signals using headphones or earphones. The specific principle of binaural rendering is as follows. People always hear sound through both ears and recognize the position and direction of a sound source therethrough. Therefore, once 3D audio is modeled into the form of an audio signal transmitted to both ears of a person, it is possible to reproduce a stereoscopic effect of 3D audio even through 2-channel audio output, without a large number of speakers. This binaural signal may also be output through a 2-channel stereo speaker.

The 2-channel stereo system has a good sound image localization effect with respect to the front thereof. However, in the case in which a 2-channel stereo system is used, it is difficult to provide the overall spatial sensation because sound images intended to be localized on the lateral sides and the rear are all reproduced through the front stereo system. In particular, in the case of a 2-channel stereo signal including a binaural signal or a binaural effect, it is difficult to provide an immersive audio experience because the signal is distorted in the process of being transmitted from the speaker to the listener.

DISCLOSURE

Technical Problem

An objective of an embodiment of the present disclosure is to provide a method and a device for processing an audio signal using a 2-channel stereo speaker.

Specifically, an objective of an embodiment of the present disclosure is to provide a method and a device for processing an audio signal using a 2-channel stereo speaker that receives a 2-channel stereo signal.

Technical Solution

An audio signal processing device according to an embodiment of the present disclosure may include a receiving end configured to receive a 2-channel stereo signal and a processor configured to process the 2-channel stereo signal. The processor may filter the 2-channel stereo signal using a spatial distortion removal filter, and may output the filtered 2-channel stereo signal to a speaker including two or more channels, and the spatial distortion removal filter may be a filter for offsetting distortion that occurs when the output signal is transmitted from the speaker to a listener. The spatial distortion removal filter may include an ipsilateral filter, which is applied to an ipsilateral signal of the 2-channel audio signal, and a contralateral filter, which is applied to a contralateral signal of the 2-channel audio signal. In at least one of the ipsilateral filter and the contralateral filter, a magnitude of a response of the spatial distortion removal filter may be limited in a frequency band of less than a predetermined value, and a magnitude of a response of the spatial distortion removal filter may not be limited in a frequency band of a predetermined value or more.

The frequency band of less than the predetermined value may be divided into a plurality of frequency bands, and threshold values of magnitudes of respective responses of the plurality of frequency bands may be different from each other.

A relatively high value may be applied to the threshold value of the magnitude of a response in a relatively low frequency band among the plurality of frequency bands.

In the case where the processor limits magnitudes of both the ipsilateral filter and the contralateral filter, a threshold value of a magnitude of a response of the ipsilateral filter and a threshold value of a magnitude of a response of the contralateral filter may be different from each other.

The ratio of the threshold value of the magnitude of the response of the ipsilateral filter to the threshold value of the magnitude of the response of the contralateral filter may be determined based on a magnitude of a response of a channel corresponding to the ipsilateral signal and a magnitude of a response of a channel corresponding to the contralateral signal in the speaker.

In the case where the magnitude of the response of the channel corresponding to the ipsilateral signal is smaller than the magnitude of the response of the channel corresponding to the contralateral signal, the threshold value of the magnitude of the response of the contralateral filter may be set to be smaller than the threshold value of the magnitude of the response of the ipsilateral filter.

The ratio of the threshold value of the magnitude of the response of the ipsilateral filter to the threshold value of the magnitude of the response of the contralateral filter may be the inverse of the ratio of the magnitude of the response of the channel corresponding to the ipsilateral signal to the magnitude of the response of the channel corresponding to the contralateral signal in the speaker.

The threshold value of the magnitude of the response of the ipsilateral filter may be smaller than the threshold value of the magnitude of a response applied to the contralateral filter.

The processor may upmix the 2-channel stereo signal, may separate the upmixed 2-channel stereo signal into a coherence signal and a non-coherence signal, may filter the non-coherence signal using the spatial distortion removal filter, and may not filter the coherence signal using the spatial distortion removal filter. The non-coherence signal may be a signal having a cross-correlation coefficient value equal to or greater than a predetermined value with respect to a specific time-frequency bin of the upmixed 2-channel audio signal. In addition, the coherence signal may be a signal having a cross-correlation coefficient value less than the predetermined value with respect to the specific time-frequency bin of the upmixed 2-channel audio signal.

An operation method of an audio signal processing device according to the present disclosure may include: receiving a 2-channel stereo signal; filtering the 2-channel stereo signal using a spatial distortion removal filter; and outputting the filtered 2-channel stereo signal to a speaker including two or more channels. The spatial distortion removal filter may be a filter for offsetting distortion that occurs when the output signal is transmitted from the speaker to a listener, and may include an ipsilateral filter applied to an ipsilateral signal of the 2-channel audio signal and a contralateral filter applied to a contralateral signal of the binaural signal. In at least one of the ipsilateral filter and the contralateral filter in the spatial distortion removal filter, a magnitude of a response of the spatial distortion removal filter may be limited in a frequency band of less than a predetermined value, and a magnitude of a response of the spatial distortion removal filter may not be limited in a frequency band of a predetermined value or more.

The frequency band of less than the predetermined value may be divided into a plurality of frequency bands, and threshold values of the magnitudes of respective responses of the plurality of frequency bands may be different from each other.

A relatively high value may be applied to the threshold value of the magnitude of a response in a relatively low frequency band among the plurality of frequency bands.

In the case where the audio signal processing device limits the magnitudes of both the ipsilateral filter and the contralateral filter, a threshold value of a magnitude of a response of the ipsilateral filter and a threshold value of a magnitude of a response of the contralateral filter may be different from each other.

The ratio of the threshold value of the magnitude of the response of the ipsilateral filter to the threshold value of the magnitude of the response of the contralateral filter may be determined based on a magnitude of a response of a channel corresponding to the ipsilateral signal and a magnitude of a response of a channel corresponding to the contralateral signal in the speaker.

In the case where the magnitude of a response of the channel corresponding to the ipsilateral signal is smaller than the magnitude of a response of the channel corresponding to the contralateral signal, the threshold value of the magnitude of the response of the contralateral filter may be set to be smaller than the threshold value of the magnitude of the response of the ipsilateral filter.

The ratio of the threshold value of the magnitude of the response of the ipsilateral filter to the threshold value of the magnitude of the response of the contralateral filter may be the inverse of a ratio of a magnitude of a response of the channel corresponding to the ipsilateral signal to a magnitude of a response of the channel corresponding to the contralateral signal in the speaker.

The threshold value of the magnitude of the response of the ipsilateral filter may be smaller than the threshold value of the magnitude of the response applied to the contralateral filter.

The operation method may further include: upmixing the 2-channel stereo signal; separating the upmixed 2-channel stereo signal into a coherence signal and a non-coherence signal; filtering the non-coherence signal using the spatial distortion removal filter; and not filtering the coherence signal using the spatial distortion removal filter. The non-coherence signal may be a signal having a cross-correlation coefficient value equal to or greater than a predetermined value with respect to a specific time-frequency bin of the upmixed 2-channel audio signal, and the coherence signal may be a signal having a cross-correlation coefficient value less than the predetermined value with respect to the specific time-frequency bin of the upmixed 2-channel audio signal.

Advantageous Effects

An embodiment of the present disclosure provides a method and a device for processing an audio signal using a 2-channel stereo speaker.

MODE FOR CARRYING OUT THE INVENTION

Figure 1:
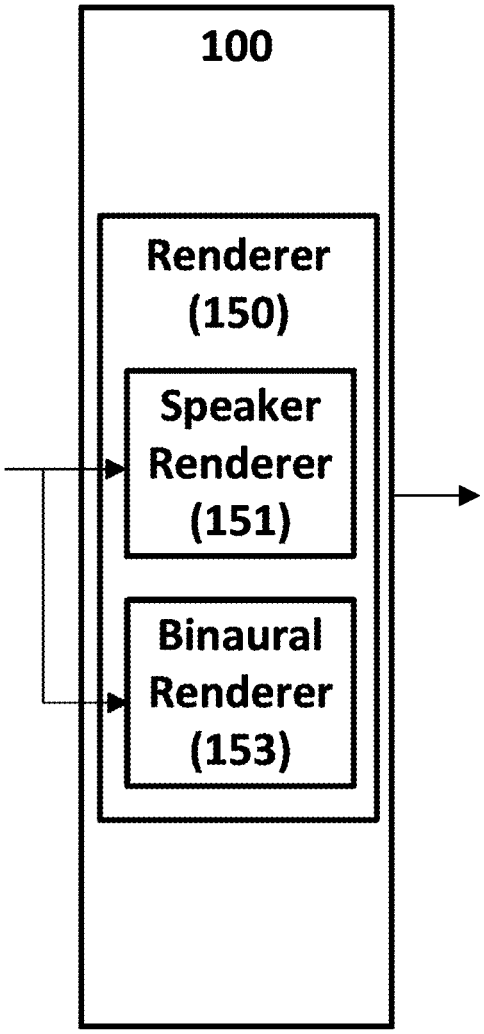
FIG. 1 shows an audio signal processing device according to an embodiment of the present disclosure.

Hereinafter, embodiments of the present disclosure will be described in detail with reference to the accompanying drawings so that those of ordinary skill in the art may easily implement the present disclosure. However, the present disclosure may be implemented in various forms, and is not limited to the embodiments described herein. In addition, elements irrelevant to the description will be omitted from the drawings for clarity of description of the present disclosure, and similar elements will be denoted by similar reference numerals throughout the specification.

In addition, an expression in which a part "includes" a certain element includes the case in which the part further includes other elements, rather than necessarily excluding such other elements, unless otherwise stated.

FIG. 1 shows an audio signal processing device according to an embodiment of the present disclosure.

An audio signal processing device 100 according to an embodiment of the present disclosure includes a renderer 150. The renderer 150 may be referred to as a "processor". The renderer 150 may include at least one of a speaker renderer 151 and a binaural renderer 153. The speaker renderer 151 performs post processing for outputting at least one of a multi-channel signal, a multi-object audio signal, and a 2-channel stereo signal (e.g., a binaural signal), which are input through the receiving end of the audio signal processing device 100. The post processing may include at least one of dynamic range control (DRC), loudness normalization (LN), and peak limiting (PL). The 2-channel stereo signal may be generated by the audio signal processing device 100. Specifically, the 2-channel stereo signal may be generated by the binaural renderer 153.

The binaural renderer 153 generates a downmixed binaural signal of at least one of a multi-channel audio signal and a multi-object audio signal. The downmixed binaural signal is a 2-channel audio signal that allows each of an input channel signal and an object signal to be presented by a virtual sound source located in three dimensions. The binaural renderer 153 may receive an audio signal supplied to the speaker renderer 151 as an input signal. Binaural rendering may be performed based on a binaural room impulse response (BRIR) filter, and may be performed in a time domain or a QMF domain. The post processor 140 may further perform at least one of dynamic range control (DRC), loudness normalization (LN), and peak limiting (PL), described above as post processing of the binaural rendering.

As described above, the audio signal processing device may receive a 2-channel stereo signal, such as a binaural signal, through a receiving end, and may output the same through a speaker. The binaural signal may be an audio signal that simulates the signal transmitted to both ears of a person. Specifically, the binaural signal may be a signal recorded through microphones worn on the person's ears, a signal recorded through microphones mounted to a dummy head, or a signal generated using HRIR or BRIR. The rendered 2-channel stereo signal may be output through space, and spatial characteristics may be reflected thereto during transmission thereof from the speaker to a listener. Therefore, the sound finally delivered to the listener may be different from what the creator intended. In order to prevent this, the audio signal processing device may perform filtering to offset distortion that may be reflected in the process in which the signal is transmitted from the speaker to the listener. Specifically, the audio signal processing device may apply, to an input signal, filters that are separated into an ipsilateral filter applied to an ipsilateral signal of the 2-channel stereo signal and a contralateral filter applied to a contralateral signal of the 2-channel stereo signal. Filtering performed on an input signal by an audio signal processing device according to an embodiment of the present disclosure will be described with reference to FIGS. 2 to 4. For convenience of description, the filter applied to an input signal by the audio signal processing device will be referred to as a "spatial distortion removal filter". In addition, in the case where the spatial distortion removal filter includes an ipsilateral filter and a contralateral filter, the ipsilateral filter and the contralateral filter will be referred to as a "spatial distortion removal filter pair".

Figure 2:
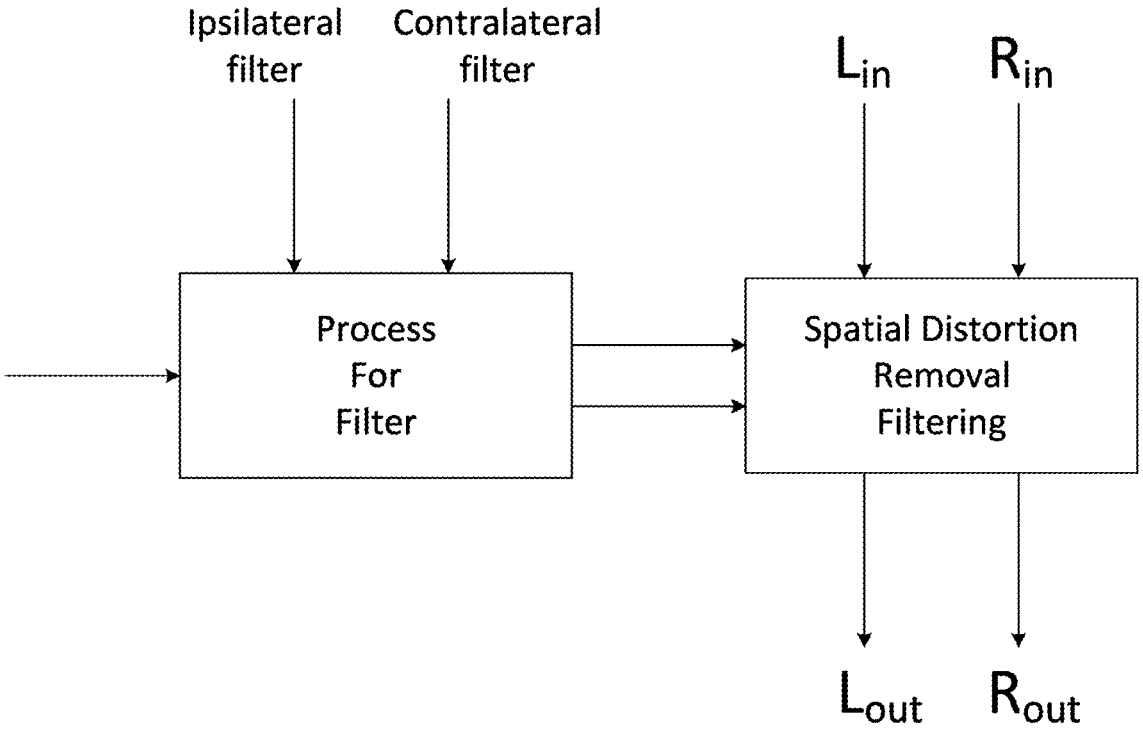
FIG. 2 shows a filtering process applied to an input signal by an audio signal processing device according to an embodiment of the present disclosure.

FIG. 2 shows a filtering process applied to an input signal by an audio signal processing device according to an embodiment of the present disclosure.

The spatial distortion removal filter may be produced based on at least one of a speaker layout, characteristics of reproduction space, positions of a speaker and a listener, and characteristics of a speaker. In this case, the speaker layout may include at least one of angles between respective pairs of speakers in the speaker layout and the overall layout of the speakers. The positions of a speaker and a listener may include at least one of relative positions of the speaker and the listener and a distance between the speaker and the listener. In addition, the characteristics of a speaker may include frequency response characteristics of each speaker.

In the case of stereo speakers, the spatial distortion removal filter may be produced based on an angle between the front of a listener and a pair of front speakers, and on the distance between the front of the listener and a pair of front speakers. In the case where the audio signal processing device applies an ideal spatial distortion removal filter pair to an input signal, the sound output from the audio signal processing device and transmitted to the listener may be the same as the sound transmitted when the listener wears headphones. This may be expressed as the following equation. For convenience of explanation, the following equation will be referred to as "Equation 1".

$$y=s\hat{}(-1)*[s*x]$$

In Equation 1, "x" is the input signal, "s" is the spatial impact response from the speaker to the listener, and "s^(−1)" is the impact response of the spatial distortion removal filter. "*" represents the convolution operation. In addition, in the case where the input signal is a 2-channel audio signal, "s" may be expressed as a matrix including s_LL, s_LR, s_RL, and s_RR, and each component may be expressed in a time domain or a frequency domain. "s_LL" indicates a filter that simulates the transmission of a left signal to the left ear through space, "s_LR" indicates a filter that simulates the transmission of a left signal to the right ear through space, "s_RL" indicates a filter that simulates the transmission of a right signal to the left ear through space, and "s_RR" indicates a filter that simulates the transmission of a right signal to the right ear through space. "s" may be expressed as follows.

$$s==[s_LLs_RL;s_LRs_RR]$$

In addition, in the case where "s" is a matrix, "s^(−1)" may be an inverse matrix or a pseudo inverse matrix. In this case, the individual frequency responses of the spatial distortion removal filter pair may have excessively amplified gain values in a specific band. Specifically, a spatial transfer function representing the signal transmitted from the speaker to the listener may be attenuated or may include a notch in a specific frequency band due to the characteristics of the space in which the speaker and the listener are located. Therefore, each spatial distortion removal filter may include an excessively amplified gain value to compensate for a frequency band in which attenuation or a notch occurs. Therefore, the signal filtered by the spatial distortion removal filter may contain an excessive response change compared to the original signal, and the excessive response change may cause tonal distortion and signal clipping in the output signal. In order to prevent this, in the frequency response of each filter in the spatial distortion removal filter pair, the magnitude of a response may be limited so as not to exceed a specific value. This will be described with reference to FIG. 3.

Figure 3:
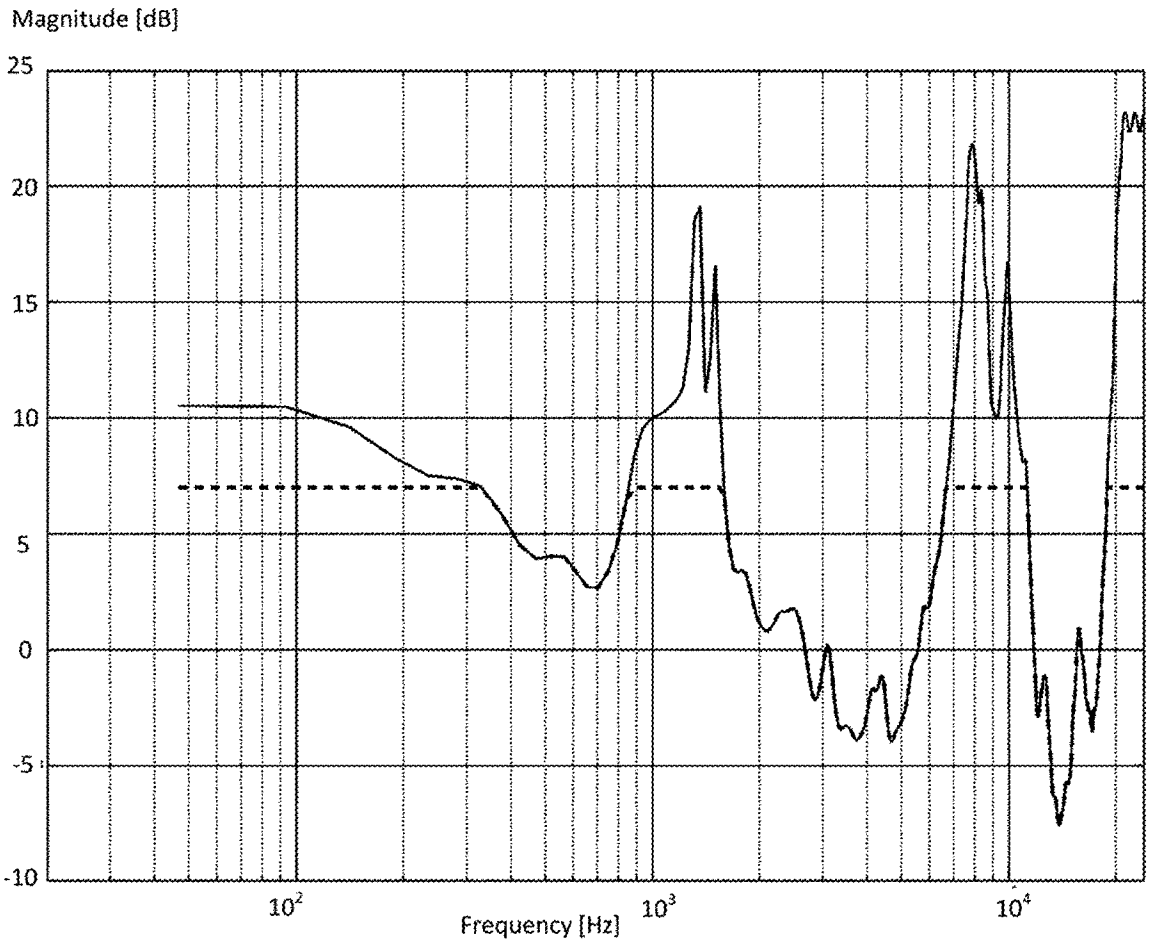
FIG. 3 shows the cases in which the magnitude of a response is limited and is not limited in a frequency response of a spatial distortion removal filter according to an embodiment of the present disclosure.

FIG. 3 shows each of the cases in which the magnitude of a response is limited and is not limited in the frequency response of a spatial distortion removal filter according to an embodiment of the present disclosure.

Specifically, in FIG. 3, the solid line shows the case where the magnitude of a response is not limited in the frequency response of the spatial distortion removal filter, and the dotted line shows the case where the magnitude of a response is limited in the frequency response of the spatial distortion removal filter. If the magnitude of a response is limited in the frequency response of the spatial distortion removal filter, it is possible to prevent an excessive change in tone while maintaining offsetting the spatial distortion effect. In this case, the audio signal processing device may not limit the magnitude of a response to a specific magnitude in a low-frequency band for higher spatial distortion removal performance. In this case, the audio signal processing device may set a threshold value for each frequency band based on the magnitude of a response of the spatial distortion removal filter, and may limit the magnitude of a response of the filter using the set threshold value for each frequency band. In particular, the audio signal processing device may set a higher threshold value in a lower frequency band.

The components of a spatial impact response in a high-frequency band may easily change even with small changes in the environment, so if all high-frequency bands are filtered using a spatial distortion removal filter, the stability of an output signal may be degraded due to excessive correction. The audio signal processing device may apply the spatial distortion removal filter to a signal in a band of less than a specific frequency, and may bypass a signal in a band of a specific frequency or more without applying the spatial distortion removal filter thereto. Through this embodiment, the audio signal processing device is able to secure the stability of an output signal, and is not required to perform an additional operation, thereby reducing the amount of computation.

In the case where the audio signal processing device limits the magnitude of a response in the frequency response of the spatial distortion removal filter pair, a threshold value of the magnitude of a response applied to the ipsilateral filter may be different from a threshold value of the magnitude of a response applied to the contralateral filter. Specifically, the threshold value of the magnitude of a response of the ipsilateral filter may be smaller than the threshold value of the magnitude of a response of the contralateral filter. This is due to the fact that the energy of the signal transmitted by the contralateral speaker is less than the energy of the signal transmitted by the ipsilateral speaker.

In addition, in the case where the audio signal processing device limits the magnitude of a response in the frequency response of the spatial distortion removal filter, the audio signal processing device may limit the magnitude of a response of the spatial distortion removal filter in a frequency band of more than a predetermined value. In this case, the audio signal processing device may limit the magnitude of a response of the spatial distortion removal filter in a frequency band of more than a predetermined value in at least one of the ipsilateral filter and the contralateral filter. Specifically, in the case where the audio signal processing device limits the magnitude of a response in the frequency response of the spatial distortion removal filter, the audio signal processing device may set a threshold value of the magnitude of a response for each frequency band. In a specific embodiment, the audio signal processing device may set a threshold value of the magnitude of a frequency response in a relatively low frequency band to be greater than a threshold value of the magnitude of a frequency response in a relatively high frequency band. This is due to the fact that the frequency response in the low-frequency band has a greater effect on the tone. These embodiments may also be applied to the case where a spatial distortion removal filter pair is used. The following equations represent an output signal in the case where a spatial distortion removal filter pair is applied to the audio signal processing device according to an embodiment of the present disclosure. For convenience of explanation, the following equations will be collectively referred to as "Equation 2".

$$l'=\text{alpha_1}(l^*\{\text{ipsilateral filter}\}_L)+\text{alpha_2}(r^*\{\text{contralateral filter}\}_L)$$

$$r'=\text{alpha_3}(l^*\{\text{contralateral filter}\}_R)+\text{alpha_4}(r^*\{\text{ipsilateral filter}\}_R)$$

In Equation 2, "l" and "r" represent left and right channel signals of an input signal, respectively. In addition, "alpha_1" to "alpha_4" represent gains multiplied by a filtered signal. "{ipsilateral filter}_L,R" represents an ipsilateral filter for L and R speaker inputs in the spatial distortion removal filter pair, and "{contralateral filter}_L, R" represents a contralateral filter for L and R speaker inputs in the spatial distortion removal filter pair. "l" and "r" denote the left channel and the right channel of the output signal, respectively. In Equation 2, {ipsilateral filter}_L={ipsilateral filter}_R, and {contralateral filter}_L={contralateral filter}_R according to the positions of a speaker and a listener, and the characteristics of space. In addition, Equation 2 represents an output signal in a time domain in the case where a spatial distortion removal filter pair is applied to the audio signal processing device according to an embodiment of the present disclosure. The same processing may be performed in the frequency domain, rather than in the time domain.

The characteristics of the response of a spatial transfer function, which represents a sound transmitted through space, change depending on the frequency band. At low frequencies, it is easy to mathematically calculate the characteristics of the transfer function using the physical characteristics of space, the position of a sound source, and the position of a listener. In addition, measurement of the spatial transfer function at a low frequency introduces a small measurement error. On the other hand, in a high-frequency band, the spatial transfer function changes very sensitively depending on the physical characteristics of space, the position of a sound source, and the position of a listener. In the case of measuring the spatial transfer function at a high frequency, the characteristics thereof are likely to be inconsistent and unstable even if the measurement is repeated. Therefore, if the spatial distortion removal filter filters all signals in a high-frequency band, the robustness of the filtered signal is likely to deteriorate. Accordingly, the audio signal processing device may bypass the spatial distortion removal filter in a frequency band of a predetermined frequency or more. In this case, the audio signal processing device may set the magnitude of a response to a predetermined value in a frequency band of a predetermined frequency or more. The predetermined value may be 1. In addition, the audio signal processing device may directly use the phase of a response of the spatial distortion removal filter in a frequency band of a predetermined frequency or more. Accordingly, the audio signal processing device may maintain the continuity of the phase of an output signal.

In the case where an input signal is a 2-channel audio signal, the audio signal processing device may render the input signal by upmixing the same. The upmixed signal may be classified into a coherence signal and a non-coherence signal. If a cross-correlation coefficient value with respect to a specific time-frequency bin of a 2-channel audio signal is greater than or equal to a specific value, the signal may be regarded as a coherence signal. Otherwise, the signal may be regarded as a non-coherence signal. Through this, the audio signal processing device may enhance a stereoscopic sound effect. Specifically, the audio signal processing device may not filter the coherence signal using a separate filter for sound image localization, i.e., a spatial distortion removal filter, and may filter the non-coherence signal using the spatial distortion removal filter. In this case, the spatial distortion removal filter may be the spatial distortion removal filter pair described above. According to this embodiment, the audio signal processing device may provide a user with an improved spatial sensation.

Speakers for outputting audio signals may have different frequency response characteristics. For example, in the case where a user uses a mobile phone equipped with stereo speakers, the frequency response characteristics of the two speakers may be different. In this case, because the sound reproduced by the respective speakers is transmitted through space, the degree of distortion thereof due to the space also varies.

Figure 4:
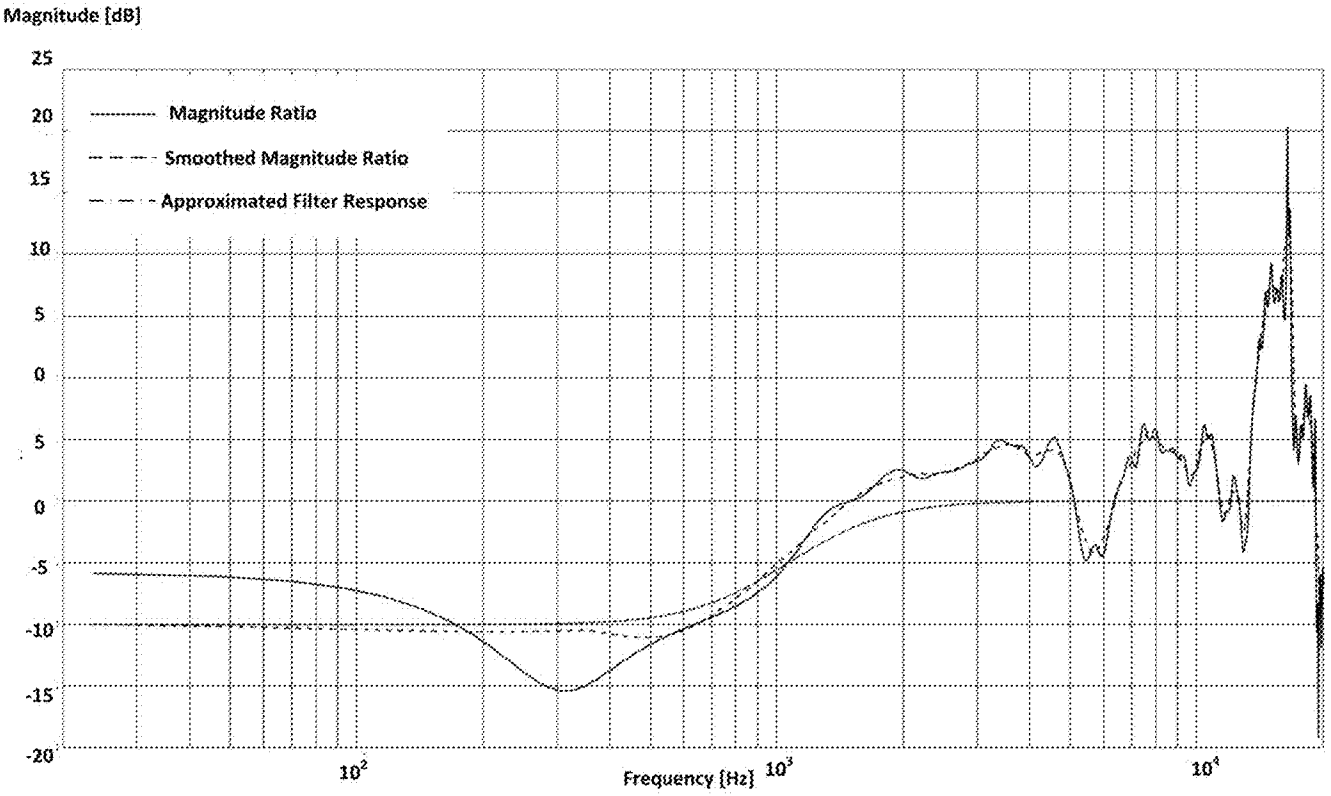
FIG. 4 shows a magnitude response ratio of a speaker that may be connected to an audio signal processing device according to an embodiment of the present disclosure.

FIG. 4 shows a magnitude response ratio of a speaker that may be connected to an audio signal processing device according to an embodiment of the present disclosure.

Specifically, FIG. 4 shows a ratio of the magnitude response of a contralateral speaker to the magnitude response of an ipsilateral speaker. In FIG. 4, the solid line represents ratios of actually measured values, and the broken line represents a smoothed ratio of the actually measured values. In addition, the alternating long and short dash line in FIG. 4 represents a response of a simplified low-pass shelving filter capable of replacing the broken line.

The degree to which the signal output from the speaker is distorted in the space may vary depending on the magnitude response of the speaker. Accordingly, the audio signal processing device may set a threshold value of the magnitude of a response of an ipsilateral filter and a threshold value of a response of a contralateral filter in a spatial distortion removal filter pair based on a ratio of the magnitude response between the channels of a binaural speaker. Specifically, if the magnitude of a response of a first channel of a binaural speaker is less than the magnitude of a response of a second channel thereof, the audio signal processing device may set a threshold value of the magnitude of a response of the filter corresponding to the second channel, among the filters of the spatial distortion removal filter pair, to be smaller than a threshold value for the magnitude of a response of the filter corresponding to the first channel, among the filters of the spatial distortion removal filter pair. In this case, the audio signal processing device may set the ratio of the threshold value of the magnitude of a response of the filter corresponding to the second speaker to the threshold value of the magnitude of a response of the filter corresponding to the first speaker to the inverse of the ratio of the magnitude of a response of the first speaker to the magnitude of a response of the second speaker. For example, in the case of the speaker used in FIG. 4, since the magnitude of a response of the ipsilateral speaker in a low-frequency band is smaller than the magnitude of a response of the contralateral speaker in a low-frequency band, the ratio of the threshold value of a response value of the contralateral filter in the low-frequency band to the threshold value of a response value of the ipsilateral filter in the low-frequency band may be set to the ratio of the magnitude of a response of the ipsilateral speaker in the low-frequency band to the magnitude of a response of the contralateral speaker in the low-frequency band.

In addition, the audio signal processing device may set a threshold value based on a simplified magnitude response of a channel of the speaker. In this case, the simplified magnitude response may be a response of a shelving filter among the responses of the channel. As shown in Equation 1, the spatial distortion removal filter is an inverse function of the spatial transfer function. The spatial transfer function may include output characteristics of a speaker.

Therefore, a spatial transfer function generated based on the ratio of magnitudes of responses between two channels of the speaker may be applied to the spatial distortion removal filter. In this case, the spatial distortion removal filter may include two or more filters. That is, when limiting the magnitude response for each element of "s^(−1)", which is the inverse function or the inverse filter matrix of "s" in the description of Equation 1, the audio signal processing device may set the threshold value, which limits the magnitude responses of s_LL and s_LR, and the threshold value, which limits the magnitude responses of s_RL and s_RR, to be different from each other. In this case, the audio signal processing device may generate an output signal using a combination of the four filters and a combination of input signals.

In the above-described embodiments, the audio signal processing device may limit the magnitude of a response of the spatial distortion removal filter. The audio signal processing device may limit the magnitude of a response of the spatial distortion removal filter for each of a plurality of frequency bands. Threshold values of the magnitudes of respective responses in the plurality of frequency bands may be different. In addition, a relatively high value may be applied to the threshold value of the magnitude of a response in a relatively low-frequency band among the plurality of frequency bands. In these embodiments, the audio signal processing device may limit the magnitude of a response of the spatial distortion removal filter in a frequency band of less than a predetermined value. In addition, the audio signal processing device may limit the magnitude of a response in at least one of the ipsilateral filter and the contralateral filter of the spatial distortion removal filter pair.

Specifically, the audio signal processing device may limit the magnitude of a response of the spatial distortion removal filter by applying multi-band dynamic range control (DRC) or a multi-band limiter to the spatial distortion removal filter. More specifically, in the case where the audio signal processing device limits the magnitude of a response of the spatial distortion removal filter for each frequency band, the audio signal processing device may apply multi-band DRC thereto. In this case, the audio signal processing device may perform soft limiting depending on the frequency band.

Specifically, the audio signal processing device may apply a higher gain to the spatial distortion removal filter as the band has a lower frequency. In addition, in the case where the audio signal processing device limits the magnitude of a response of the spatial distortion removal filter to the same magnitude regardless of the frequency band, the audio signal processing device may apply a multi-band limiter to the spatial distortion removal filter.

If the above-described embodiments are applied, the audio signal processing device is able to eliminate spatial distortion that may occur in the process in which an output signal output from a speaker is transmitted from a speaker to a listener. In addition, the audio signal processing device is able to overcome limitations as to the arrangement of the speaker in the space in which the speaker is disposed only in the front. Therefore, the audio signal processing device is capable of maximizing the effect of a 2-channel stereo signal through these embodiments.

Although the above description has been made based on binauralized audio having two channels, the embodiments described above are not limited thereto, and may be applied to a 2-channel stereo signal having a binaural effect and a 2-channel downmix stereo signal having a binaural effect, which is generated from multi-channel audio.

Although the present disclosure has been described through specific embodiments above, those skilled in the art may modify and change the present disclosure without departing from the spirit and scope of the present disclosure. That is, although the present disclosure has been described with respect to an embodiment of processing a multi-audio signal, the present disclosure may be applied and extended to various multimedia signals including video signals, as well as audio signals, in the same manner. Therefore, what can be easily inferred from the detailed description and the embodiments of the present disclosure by those skilled in the art to which the present disclosure pertains shall be interpreted as belonging to the scope of the present disclosure.

The invention claimed is:

1. An audio signal processing device comprising:

a receiving end configured to receive a 2-channel stereo signal; and a processor configured to process the 2-channel stereo signal, wherein the processor is configured to filter the 2-channel stereo signal using a spatial distortion removal filter and output the filtered 2-channel stereo signal to a speaker including two or more channels, wherein the spatial distortion removal filter is configured to offset distortion that occurs when the output signal is transmitted from the speaker to a listener and determined based on at least one of a layout of the speaker, characteristics of reproduction space, positions of the speaker and the listener, and characteristics of the speaker, and comprises an ipsilateral filter applied to an ipsilateral signal of the 2-channel audio signal and a contralateral filter applied to a contralateral signal of the 2-channel audio signal, wherein, in at least one of the ipsilateral filter and the contralateral filter, a magnitude of a response of the spatial distortion removal filter is limited in a frequency band of less than a predetermined value, and a magnitude of a response of the spatial distortion removal filter is not limited in a frequency band of the predetermined value or more, and wherein in the case where the processor limits magnitudes of both the ipsilateral filter and the contralateral filter, a threshold value of a magnitude of a response of the ipsilateral filter and a threshold value of a magnitude of a response of the contralateral filter are different from each other.

2. The audio signal processing device of claim 1, wherein the frequency band of less than the predetermined value is divided into a plurality of frequency bands, and wherein threshold values of magnitudes of respective responses of the plurality of frequency bands are different from each other.

3. The audio signal processing device of claim 2, wherein, when a first frequency is higher than a second frequency, a threshold value of magnitude of a response in the second frequency is larger than a threshold value of magnitude of a response in the first frequency.

4. The audio signal processing device of claim 1, wherein a ratio of the threshold value of the magnitude of the response of the ipsilateral filter to the threshold value of the magnitude of the response of the contralateral filter is determined based on a magnitude of a response of a channel corresponding to the ipsilateral signal and a magnitude of a response of a channel corresponding to the contralateral signal in the speaker.

5. The audio signal processing device of claim 4, wherein, in the case where the magnitude of the response of the channel corresponding to the ipsilateral signal is smaller than the magnitude of the response of the channel corresponding to the contralateral signal, the threshold value of the magnitude of the response of the contralateral filter is set to be smaller than the threshold value of the magnitude of the response of the ipsilateral filter.

6. The audio signal processing device of claim 5, wherein the ratio of the threshold value of the magnitude of the response of the ipsilateral filter to the threshold value of the magnitude of the response of the contralateral filter is an inverse of a ratio of the magnitude of the response of the channel corresponding to the ipsilateral signal to the magnitude of the response of the channel corresponding to the contralateral signal in the speaker.

7. The audio signal processing device of claim 1, wherein the threshold value of the magnitude of the response of the ipsilateral filter is smaller than the threshold value of the magnitude of the response applied of the contralateral filter.

8. The audio signal processing device of claim 1, wherein the processor is configured to upmix the 2-channel stereo signal, separate the upmixed 2-channel stereo signal into a coherence signal and a non-coherence signal, filter the non-coherence signal using the spatial distortion removal filter, and not filter the coherence signal using the spatial distortion removal filter, wherein the non-coherence signal is a signal having a cross-correlation coefficient value equal to or greater than a predetermined value with respect to a specific time-frequency bin of the upmixed 2-channel audio signal, and wherein the coherence signal is a signal having a cross-correlation coefficient value less than the predetermined value with respect to the specific time-frequency bin of the upmixed 2-channel audio signal.

9. An operation method of an audio signal processing device, the method comprising:

receiving a 2-channel stereo signal;

filtering the 2-channel stereo signal using a spatial distortion removal filter; and outputting the filtered 2-channel stereo signal to a speaker including two or more channels, wherein the spatial distortion removal filter is configured to offset distortion that occurs when the output signal is transmitted from the speaker to a listener and determined based on at least one of a layout of the speaker, characteristics of reproduction space, positions of the speaker and the listener, and characteristics of the speaker, and comprises an ipsilateral filter applied to an ipsilateral signal of the 2-channel audio signal and a contralateral filter applied to a contralateral signal of the 2-channel audio signal, wherein, in at least one of the ipsilateral filter and the contralateral filter, a magnitude of a response of the spatial distortion removal filter is limited in a frequency band of less than a predetermined value, and a magnitude of a response of the spatial distortion removal filter is not limited in a frequency band of a predetermined value or more, and wherein in the case where the audio signal processing device limits magnitudes of both the ipsilateral filter and the contralateral filter, a threshold value of a magnitude of a response of the ipsilateral filter and a threshold value of a magnitude of a response of the contralateral filter are different from each other.

10. The operation method of claim 9, wherein the frequency band of less than the predetermined value is divided into a plurality of frequency bands, and wherein threshold values of magnitudes of respective responses of the plurality of frequency bands are different from each other.

11. The operation method of claim 10, wherein, when a first frequency is higher than a second frequency, a threshold value of magnitude of a response in the second frequency is larger than a threshold value of magnitude of a response in the first frequency.

12. The operation method of claim 9, wherein a ratio of the threshold value of the magnitude of the response of the ipsilateral filter to the threshold value of the magnitude of the response of the contralateral filter is determined based on a magnitude of a response of a channel corresponding to the ipsilateral signal and a magnitude of a response of a channel corresponding to the contralateral signal in the speaker.

13. The operation method of claim 12, wherein in the case where the magnitude of the response of the channel corresponding to the ipsilateral signal is smaller than the magnitude of the response of the channel corresponding to the contralateral signal, the threshold value of the magnitude of a response of the contralateral filter is set to be smaller than the threshold value of the magnitude of the response of the ipsilateral filter.

14. The operation method of claim 13, wherein the ratio of the threshold value of the magnitude of the response of the ipsilateral filter to the threshold value of the magnitude of the response of the contralateral filter is an inverse of a ratio of the magnitude of the response of the channel corresponding to the ipsilateral signal to the magnitude of the response of the channel corresponding to the contralateral signal in the speaker.

15. The operation method of claim 9, wherein the threshold value of the magnitude of the response of the ipsilateral filter is smaller than the threshold value of the magnitude of the response applied to the contralateral filter.

16. The operation method of claim 9, further comprising:

upmixing the 2-channel stereo signal;

separating the upmixed 2-channel stereo signal into a coherence signal and a non-coherence signal;

filtering the non-coherence signal using the spatial distortion removal filter; and not filtering the coherence signal using the spatial distortion removal filter, wherein the non-coherence signal is a signal having a cross-correlation coefficient value equal to or greater than a predetermined value with respect to a specific time-frequency bin of the upmixed 2-channel audio signal, and wherein the coherence signal is a signal having a cross-correlation coefficient value less than the predetermined value with respect to the specific time-frequency bin of the upmixed 2-channel audio signal.

* * * * *